US007360349B2

(12) United States Patent
Walker

(10) Patent No.: US 7,360,349 B2
(45) Date of Patent: Apr. 22, 2008

(54) ADJUSTABLE SADDLE

(75) Inventor: Daniel Alexander Lloyd Walker, London (GB)

(73) Assignee: Quantum Saddle Co Limited, Lancaster (GB)

( * ) Notice: Subject to any disclaimer, the term of this patent is extended or adjusted under 35 U.S.C. 154(b) by 397 days.

(21) Appl. No.: 10/469,203

(22) PCT Filed: Mar. 3, 2002

(86) PCT No.: PCT/GB02/00902

§ 371 (c)(1),
(2), (4) Date: Apr. 26, 2004

(87) PCT Pub. No.: WO02/070400

PCT Pub. Date: Sep. 12, 2002

(65) Prior Publication Data

US 2004/0182051 A1 Sep. 23, 2004

(30) Foreign Application Priority Data

Mar. 3, 2001 (GB) ..... 0105336.2

(51) Int. Cl.
*B68C 1/04* (2006.01)

(52) U.S. Cl. ..... 54/44.3

(58) Field of Classification Search ..... 54/38.1, 54/44.1, 44.5, 44.3, 44.7, 46.1, 46.2
See application file for complete search history.

(56) References Cited

U.S. PATENT DOCUMENTS

| | | | | |
|---|---|---|---|---|
| 3,624,695 A | | 11/1971 | Roberts | |
| 3,835,621 A | | 9/1974 | Gorenschek | |
| 4,110,857 A | | 9/1978 | Banister | |
| 4,860,524 A | | 8/1989 | Dumoulin et al. | |
| 4,996,827 A | * | 3/1991 | Pellew | 54/44.3 |
| 5,274,986 A | * | 1/1994 | Gonzales | 54/44.1 |
| 5,884,459 A | * | 3/1999 | Biddlecome | 54/44.1 |
| 6,044,630 A | | 4/2000 | Coffin | |
| 6,116,684 A | | 9/2000 | Williams | |
| 6,453,652 B1 | * | 9/2002 | Hennig | 54/44.1 |
| 6,523,332 B1 | * | 2/2003 | Erb | 54/44.5 |

FOREIGN PATENT DOCUMENTS

| | | | |
|---|---|---|---|
| DE | 296 18 321 | | 3/1997 |
| EP | 0 411 771 A1 | | 2/1991 |
| EP | 1048611 A1 | * | 11/2000 |
| GB | 25340 | | 0/1911 |
| GB | 2254234 A | * | 10/1992 |
| GB | 2 317 550 | | 4/1998 |
| GB | 2 330 513 | | 4/1999 |
| WO | WO 92/12094 | | 7/1992 |

* cited by examiner

*Primary Examiner*—Son T. Nguyen
(74) *Attorney, Agent, or Firm*—Fay Kaplun & Marcin, LLP.

(57) ABSTRACT

An equestrian saddle comprises a modular construction including a tree having two side panels connected by a bridge of hinged construction whereby the side panels are angularly adjustable, and a seat plate secured to the side panels.

22 Claims, 7 Drawing Sheets

ADJUSTABLE SADDLE

This invention concerns improvements in or relating to equestrian saddles.

In particular, the present invention has reference to the construction of such saddles.

The construction of equestrian saddles has remained in principle the same for many years and includes as a main structural component a 'tree' which provides the base on which the remaining features of the saddle are mounted either directly or indirectly, with the assembly being effected largely by hand.

The materials of which the various components are produced are essentially traditional, namely leather and flock stuffing, although synthetic materials have been proposed and saddles manufactured therefrom have been and remain available commercially. The principal benefit to be had from synthetic saddles is that of lower cost compared to those made from leather.

The fitting of saddles to horses is a skilled undertaking and professional bodies exist to regulate the saddlery profession. It will be understood that malfitting saddles can and do have a seriously adverse effect upon the horse's back causing discomfort and potential injury. Equally, the rider will experience difficulty in assuming a correct riding posture if the saddle geometry is misaligned or inadequate or there is lumpy stuffing of the panels in contact with the horse's back. It is thus important to achieve the right balance for the saddle in position on the horse's back.

The saddle tree is traditionally made of wood either in solid or laminated form, the latter being the more usual in this day and age. In the alternative, the tree may be formed of a synthetic material such for example as fibreglass which is lightweight.

The shape of the tree determines the shape of the saddle with the front, pommel, part leading to a rear, cantle, part the two parts being conjoined by an intermediate section in the form of a framework which serves as a supporting structure for the remainder of the saddle. It is usual to provide steel reinforcement for the tree particularly around the pommel and cantle regions of the saddle in order to give the saddle structure some rigidity so that it may sit firmly on the horse's back.

In order to create the saddle, the generation of the seat is of vital importance and is achieved by providing a latticework of webs tightly drawn between the pommel and the cantle on which are then placed pieces of felt and/or leather on the broadest part of the saddle to ensure that when the seat is completed it does not fall away at the edges. A piece of tightly stretched canvas is then placed over this assembly with a layer of serge or equivalent then being placed over it and stitched down, there being provision for the insertion of wool padding between the canvas and the serge to give a soft seat are for the saddle. An appropriate leather layer, e.g. pigskin, is attached and stretched on and to this leather are welded in skirts. It is known to introduce other media between the leather seat and the serge in order to enhance comfort. In this connection, sorbo-rubber or silica gel has been and is employed for this purpose.

The saddle flaps and finally the side panels are attached to the tree and it is the panel which contacts the back of the horse with clearance being given centrally by way of an arch or channel separating each side panel to accommodate and give clearance to the spine. The panels are of especial importance in that they must afford comfort to the horse when in situ. The panels will usually be of leather filled with a wool stuffing. The amount of stuffing can be varied to allow customisation.

It can therefore be seen that conventional saddle making is very time consuming, laborious and thus expensive, and accordingly there is a need for simplifying the production procedure.

It is an object of the present invention to provide a new and improved construction of saddle that will simplify the assembly of the saddle components into the whole.

Accordingly the invention provides a saddle including a tree having a pommel end and a cantle end and including in modular form, two side panels conjoined at the pommel end by a bridge capable of adjustment to vary the included angle between the two side panels, a girth mounting provided for each of the side panels and adapted in use to spread the loading along the length of the side panels, a stirrup mount on each of the side panels, a girth panel adapted for securement to each of the side panels, and a seat for supermounting the tree.

The tree further includes a seat plate overlying and secured to the side panels.

The tree is conveniently formed of a lightweight material which may be a lightweight polymer, a lightweight polymer reinforced with carbon fibre, or may be formed of carbon fibre to yield a lightweight tree. At the pommel end of the tree is provided the bridge which is hingedly connected to the side panels through the agency of brackets, conveniently made of lightweight alloy, securely mounted in the side panels. for example by bonding or a combination of bonding and conventional fixtures, for example screws. Each bracket is so formed that it provides an abutment ledge which forms a slot or slideway with a corresponding formation on the bridge.

The angular adjustment of the bridge in one embodiment is achieved by the use of variable width spacers engaging the abutment ledges thus occasioning a variation in the angular disposition of the side panels by effecting hinging movement of the panels in relation to the brackets. The greater the width of the spacers the smaller will be the included angle and vice versa. The spacers may be joined by a cross bar or locating member which positively aligns the spacers in the appropriate distanced relationship. The cross bar or locating member may conveniently be provided with a fixing point whereby other modular components of the saddle may be secured to the tree. In the alternative the bridge itself is provided with such a fixing point.

The girth mounting is preferably comprised of three pivotable suspension elements provided with suitable apertures through which in use webbing or other suitable material is reaved, the webbing connecting with a girth plate which is adapted to provide a connection for a conventional girth. In this manner the usual girth transmits force to the tree through the three suspension elements thereby spreading the loading on the tree along its length. Accordingly for the comfort of the horse the single concentrated band width of pressure associated with conventional saddles is avoided to give a more balanced and evenly spread loading at three locations on each side panel. Furthermore the movement of the horse necessarily transmits movement to the saddle and the multi-point girth suspension compensates through the provision of the pivotable elements.

The stirrup mounts are conveniently moulded into the side panels thus obviating the need for additional fixings and the requirement for post-assembly. The exposed portion of each mount is proud of the surface of the side panel thus creating a small cantilever effect that allows for a degree of flexibility in the mount, which may be made of stainless steel. This slight flexibility allows for some deflection of the load through the withers of the horse, caused by the weight of the rider standing on the stirrups.

A further bridge may be provided in the cantle region to give stability to the tree, preventing the side panels from splaying outwardly. This further bridge may be of fabric and is attached to the side panels stretching over the gullet formed between the side panels.

Each girth panel is advantageously constructed from a combination of two layers of thermoformed low density polyethylene (LDPE) foams. The upper layer is the more structural of the two and is denser than the lower. The upper layer conforms to the curvature of the side panel. The lower layer provides the flexibility for conforming to the contours of the horse's back. The girth panels are attached to the side panels by a combination of screws and bonding.

The girth panels are covered in outer surface materials, or 'trim'. These materials comprise two specific areas, namely those on the underside of the panels that are exposed to the horse's back and those on the upper areas exposed to the elements and abrasion caused by the girth straps. In both cases preferably waterproof, breathable and highly durable materials are desired. An additional 'spacer' fabric may be provided between the core of the girth panels and the outer layers, the fabric being a flexible three-dimensional material which will fill in any voids. The material is preferably sealed on one side providing a breathable cavity, which stops moisture absorbing into the foam materials of the saddle. The surface of the relatively upper trim may be provided with stitched areas of Velcro which allows the knee roll to have a degree of flexibility along the leading edges of the panels.

The seat plate of the tree is conveniently made of lightweight material for example a lightweight polymer, a lightweight polymer reinforced with carbon fibre or carbon fibre and provided advantageously with an alloy inlay to provide some degree of rigidity. Overlying the seat plate is a thermoform seat pad of LDPE foam bonded to the plate and covered in a fabric. Conveniently a channel runs along the centre of the seat and in use alleviates pressure from the coccyx and perineum in the lower region of the rider's back and groin respectively.

The underside of each girth panel may be ribbed longitudinally to provide a means whereby air flow is enabled between the saddle and the horse's back to allow a degree of ventilation and thus to reduce the heat retained in that region. In this respect, it is envisaged that it may be possible to obviate the need for a numnah.

If necessary, means may be provided for levelling the saddle. The physical contours of horses vary considerably and often the placement of a saddle on the horse's back illustrates an unevenness with the pommel for example being higher than the cantle. In this event, the invention provides a wedge adjustment element for interaction beneath the saddle seat to compensate for the unevenness.

Resilient suspension elements may be provided for the saddle to absorb any peak loadings during use.

By way of example only, one embodiment of saddle in accordance with the present invention is described below with reference to the accompanying drawings in which.

Figure 3:
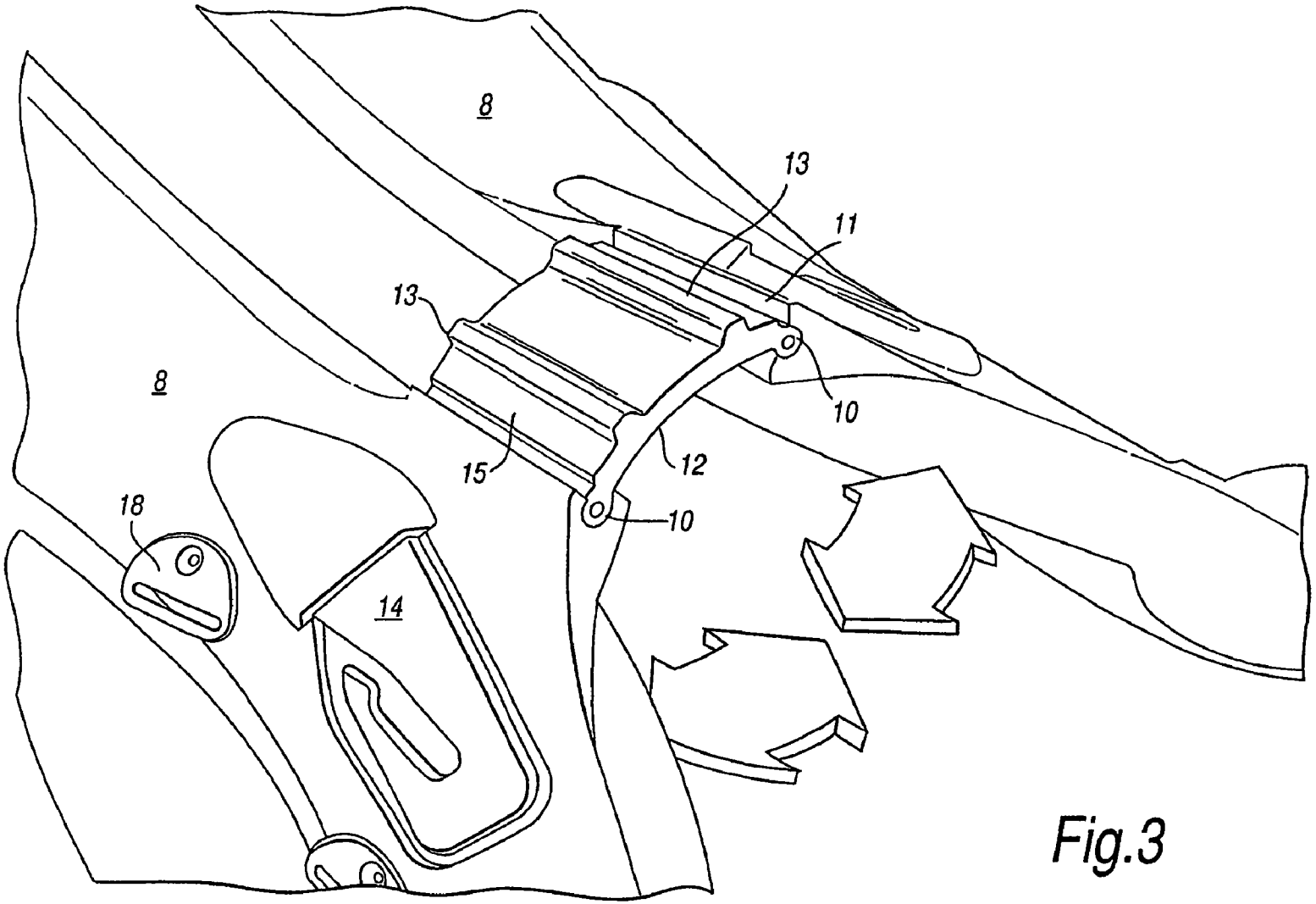
FIG. 3 is a perspective view of a further detail shown in FIG. 1.
Figure 4:
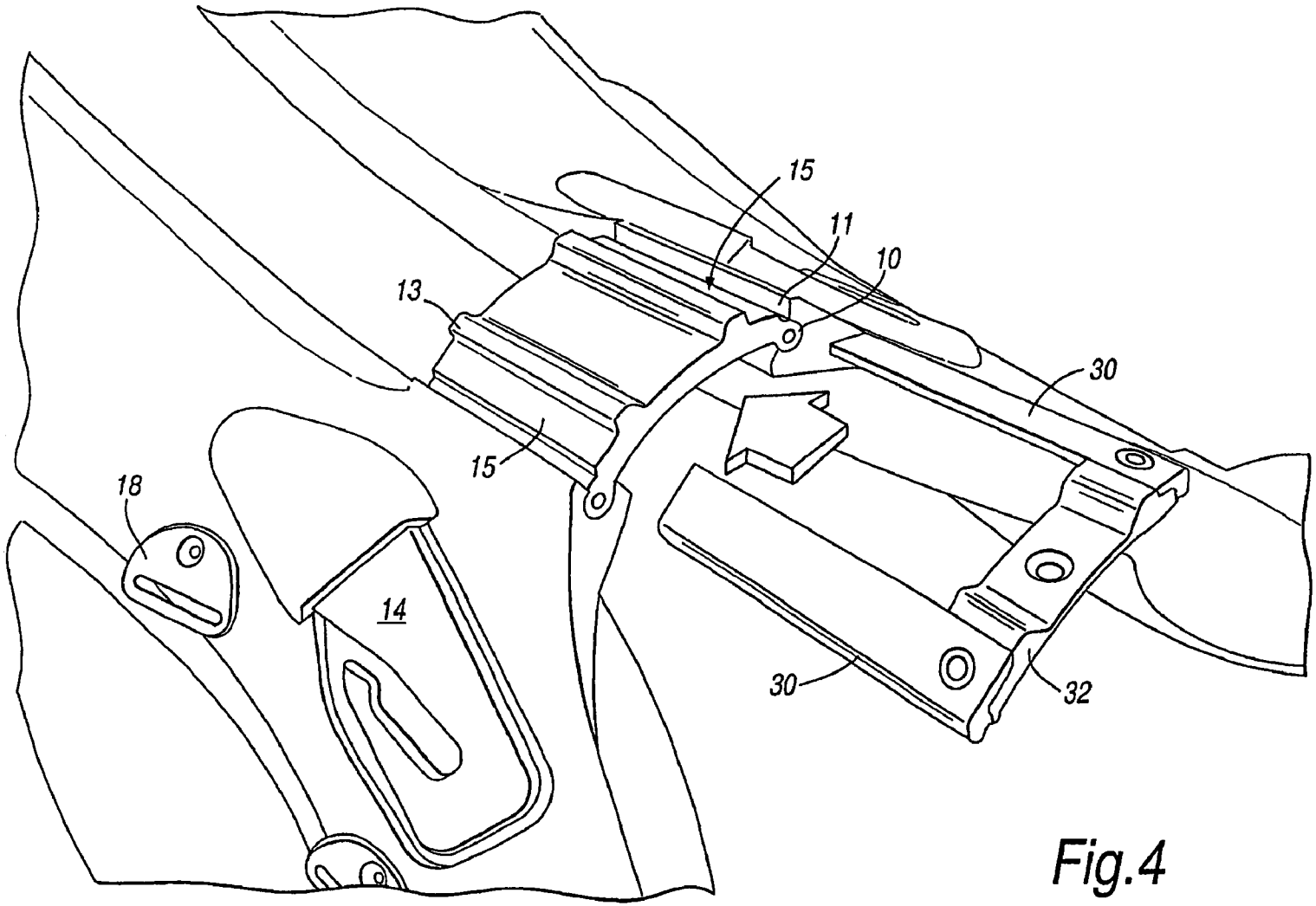
FIG. 4 is a perspective view of another detail of the saddle.
Figure 5:
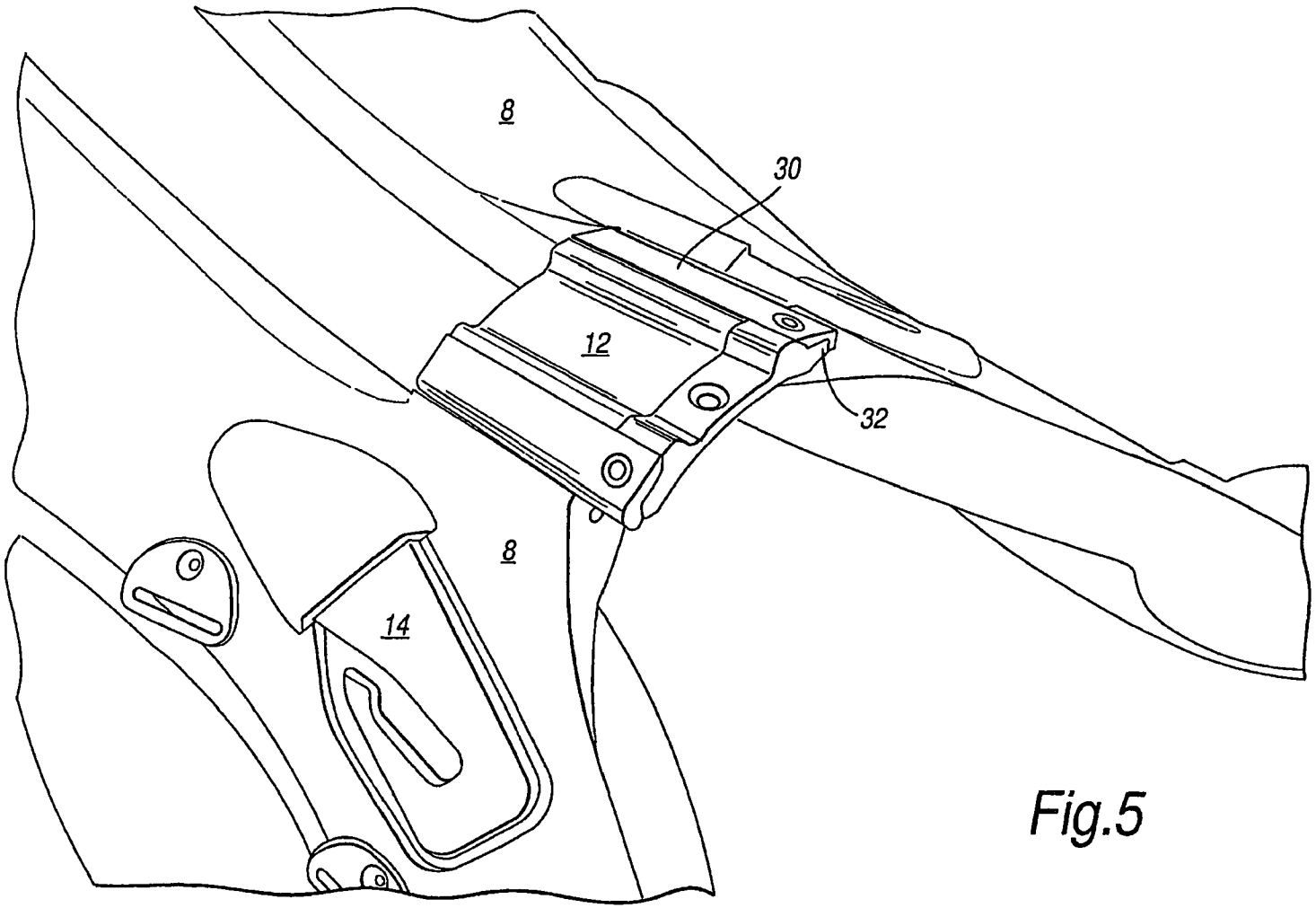
FIG. 5 is perspective view of the detail shown in FIG. 4 in position on the saddle.
Figure 6:
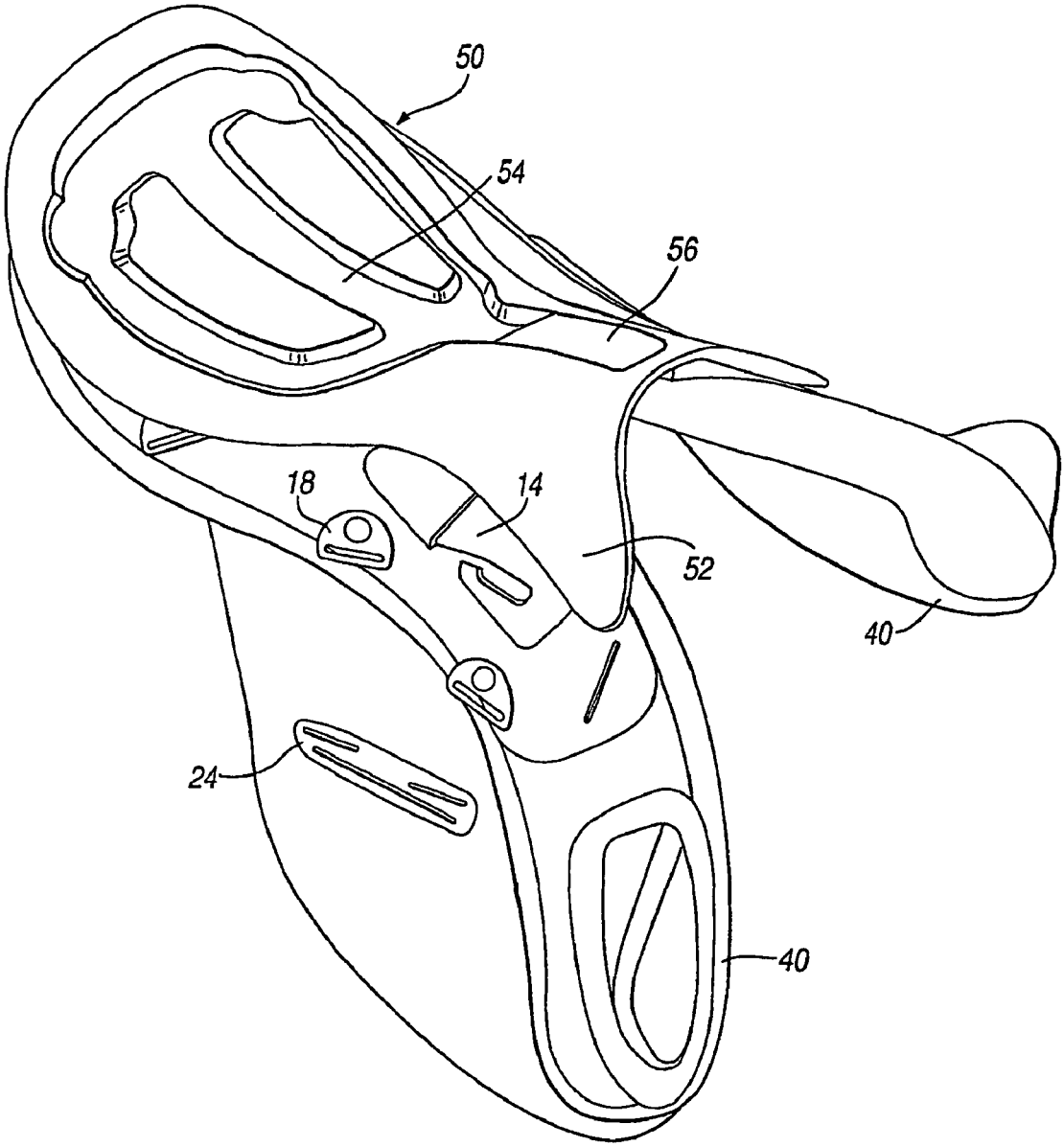
FIG. 6 is a further perspective view of the saddle with the saddle plate in position.
Figure 7:
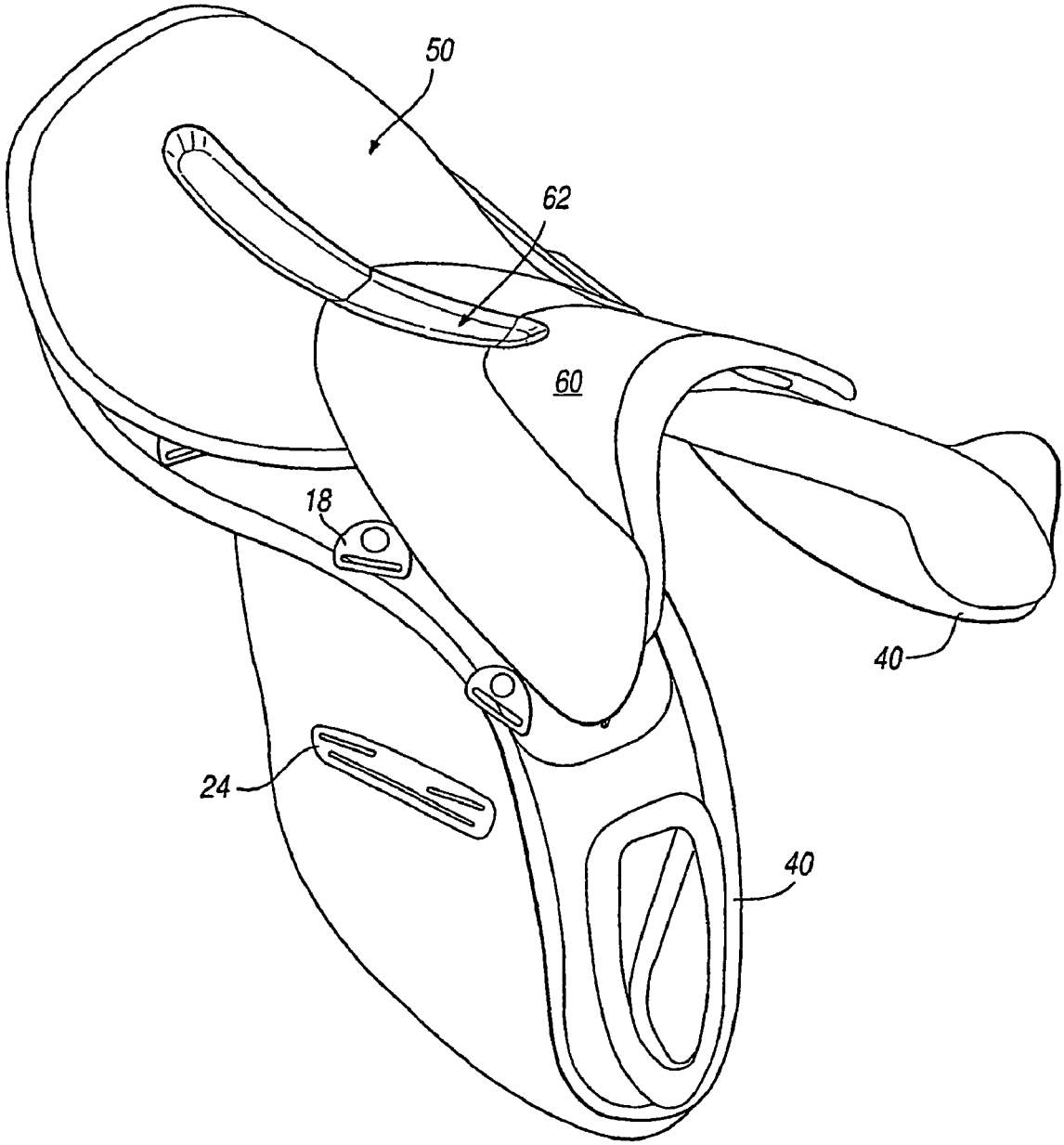
FIG. 7 is a further perspective view of the saddle with the seat pad in position.

Referring to the drawings, a saddle 1 includes a tree 2 that is produced from carbon fibre and extends from the pommel region 4 to the cantle region 6. The tree consists of two side panels 8 each of which is provided at the pommel region 4 with a hinged mounting 10 for a bridge 12, made of light alloy, which interconnects the panels 8 in articulated manner, as shown in FIG. 3, to provide for angular movement such as to vary the included angle between the side panels. Each mounting 10 has an abutment 11 and the bridge 12 has on each longitudinal margin a corresponding abutment 13, the abutments together forming a slot or slideway 15 for a purpose to be described below.

A fabric connector or bridge 17 interconnects the panels 8 in the cantle region as shown.

Each side panel 8 is provided with a stirrup leather mounting 14 the root part of which is moulded into the material from which the panel is made, the mounting being provided with a bar 16 external to the material and proud of the surface thus affording a degree of cantilever to the bar.

Figure 1:
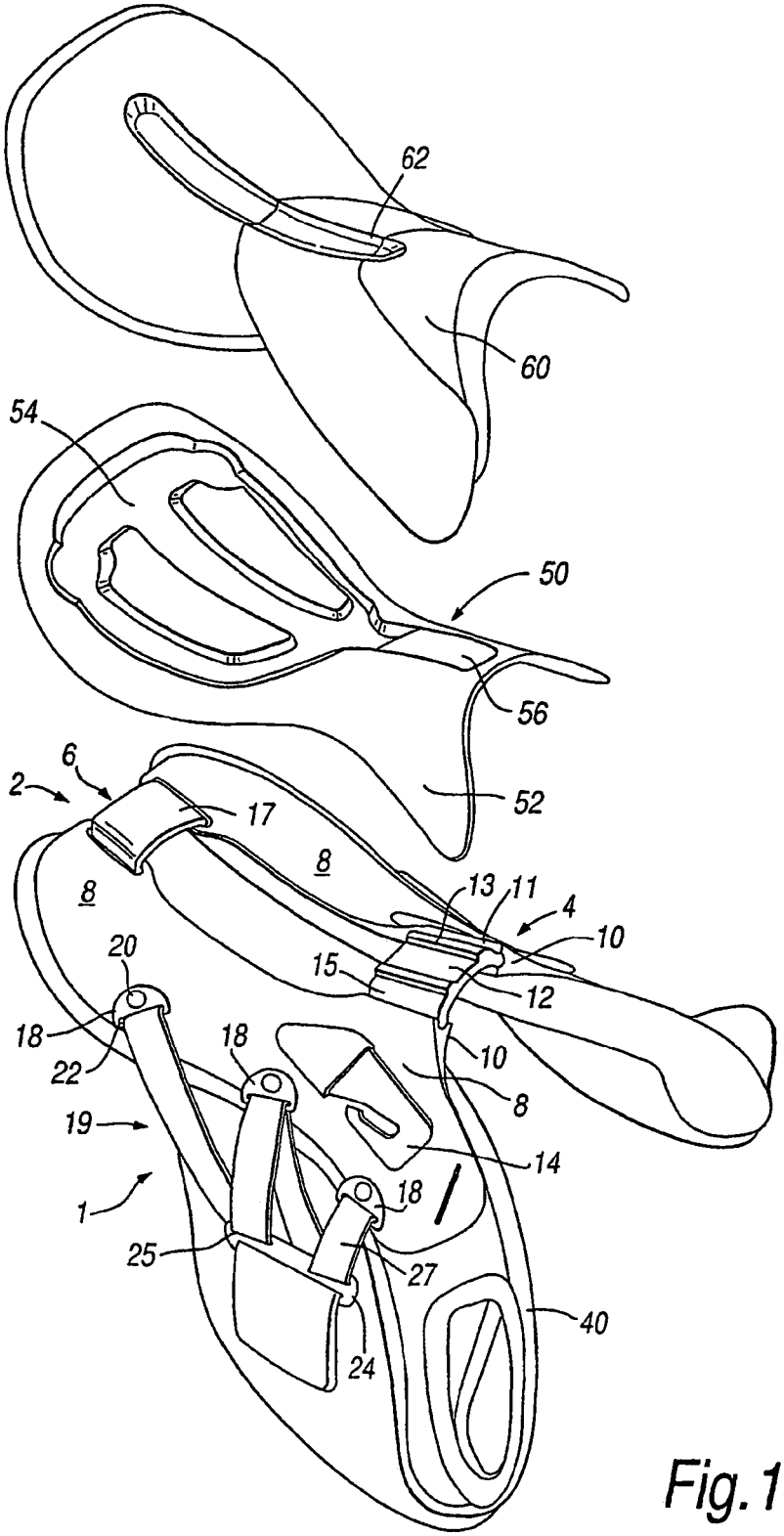
FIG. 1 is an exploded perspective view of a saddle.
Figure 2:
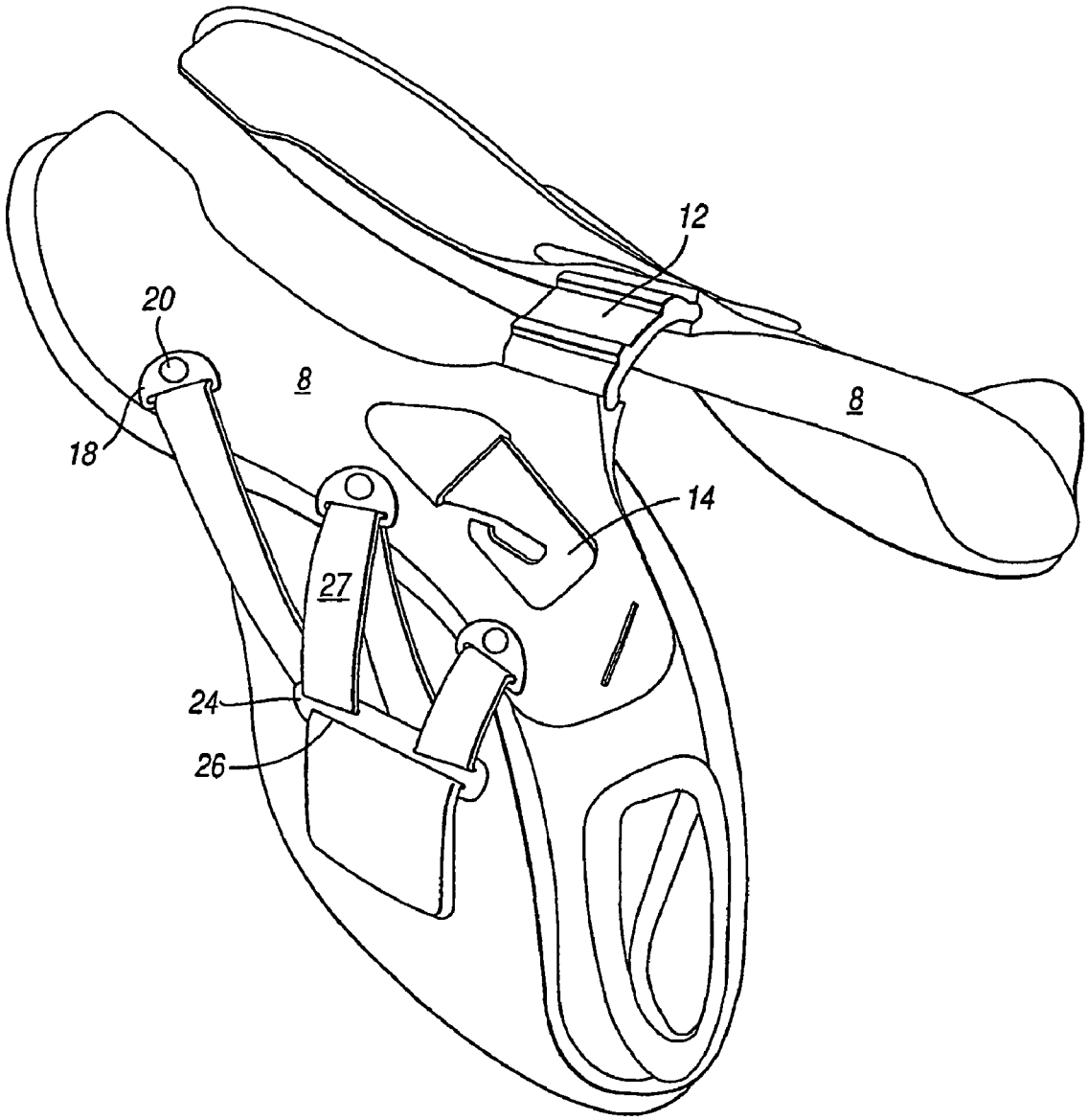
FIG. 2 is a perspective view of part of a saddle showing a detail of FIG. 1.

Each side panel 8 further includes a girth mounting 19 comprising three spaced apart mounting brackets 18 which swivel on respective pins 20 bonded into the panel material, each bracket 18 having a slot 22. A main bracket 24 having slots 25 and 26 depends on each side of the saddle through the agency of webbing 27 reaved though the slots 22 and the slots 25 in 'W' formation as shown in FIGS. 1 and 2. In use a girth (not shown) would be connected by conventional means, i.e. a buckle arrangement, to the bracket 24 using the slot 26.

The angular variation of the side panels is effected by virtue of the hinged arrangement at the pommel region of the tree and the actual angular orientation of the side panels is secured by the use of a light alloy spacer 30 that locates in the slot or slideway 15 between the abutments 11 and 13. A cross piece 32 is provided and is secured to the spacers 30 by means of pins 34 and also affords a fixing point 36 for another part of the saddle. The lateral dimension of the spacer 30 dictates the degree of angularity between the side panels and accordingly the wider the spacers 30 the narrower the angle. In the specific embodiment described the range of angular movement and therefore adjustment is from 0-16°.

Secured to each of the side panels 8 is a girth panel 40 constructed of a combination of two layers of thermoformed LDPE foams, the relatively upper layer being the more structural of the two and is denser than the lower. The upper layer conforms to the curvature of the side panel 8, whilst the lower layer provides flexibility conforming to the horse's back. The panels 40 are secured to the panel 8 by a combination of screws and bonding, and are covered in an outer surface material or 'trim'. The outer surface materials are divided into two specific areas, namely those on the panel 40 facing the horse's back, and the upper area which is exposed to the elements and abrasion caused by the girth straps. In both instances the material is waterproof, breathable and highly durable material. Between the foam core and the outer layer an additional spacer layer (not shown) is provided and is a flexible three-dimensional material which fills any voids within the panel. The spacer layer is also sealed on one side providing a breathable cavity that stops moisture absorbing into the foam elements of the saddle. The surface of the upper trim has stitched areas of Velcro allowing the knee roll (not shown) to have a degree of flexibility along the leading edge of the side panels.

A seat plate 50 is part of the tree, is produced of the same material as the side panels 8 and is secured thereto through the agency of the bridge 12 and the cross piece at the fixing point 36 by means of suitable mechanical fastening such as a screw (not shown). The plate 50 constitutes the structural element of the saddle seat with a carbon fibre margin 52 having a central light alloy centre part 54 carrying a block 56 at the pommel end. The block 56 supermounts the bridge to which it is positively secured using the fixing point 36 on the cross piece. The seat plate 50 may be provided with longitudinal spars (not shown) to increase its stiffness.

Overlying the seat plate 50 is a thermoform seat pad 60 of a similar construction to that of the side panels 8, namely of LDPE foam. The seat pad 60 is bonded to the plate 50 and trimmed in fabric (not shown). A channel 62 extends along the centre of the pad 60 and is intended to relieve the pressure from the coccyx and perineum in the lower region of the rider's back and groin respectively.

The advantage of the saddle of the present invention resides in its lightweight construction and its versatility in terms of its modularity and adjustability. The angular adjustment afforded by the hinge arrangement at the bridge allows the saddle to be fitted to any horse. The provision of the spacers facilitates this adjustment and different sized spacers can be employed for the respective nearside and offside of the saddle to accommodate variations in the horse's body profile. The side panels are then locked in position by virtue of the interaction between the spacers and the bridge and its mountings on the side panels. Further adjustment of the longitudinal horizon of the saddle can be effected by the use of a wedge to effect any necessary equalisation to give the saddle an essentially horizontal disposition on the horse's back, given that the pommel and the cantle should be at the same general level.

All the elements of the saddle, namely the tree, the seat, the side panels and their assembly, and the girth panels are preformed and then assembled together to constitute a complete saddle. The tree is secured to the bridge by means of screws and bonding or equivalent fixtures and the remaining elements are suitably adhered as required.

All the elements of the saddle are preferably made from lightweight materials and the degree of flexibility afforded by the hinge arrangement of the side panels as aforesaid allows conformity to the shape of the horse without the need for reflocking or other basic adjustment of the saddle structure as would normally be required with conventional saddle construction.

Furthermore, the ribbing which may be provided on the underside of the side panels offers a means of ventilating the contact region between the saddle and the horse's back thereby providing a more comfortable arrangement.

The present invention thus affords the capability of ease of manufacture on a production scale coupled with the capacity of the saddle to accommodate in comfortable fashion the varied contours of the horse's body.

The invention claimed is:

1. A saddle, comprising:

a tree having a pommel end and a cantle end, the tree including a bridge and two side panels, the two side panels being conjoined only at the pommel end, the bridge conjoining the side panels and being adjustable to vary an angle between the side panels;

a girth mounting provided for each of the side panels, the girth mounting spreading loading along a length of each of the side panels;

a stirrup mount situated on each of the side panels;

a girth panel secured to each of the side panels; and a seat supermounting the tree.

2. A saddle according to claim 1, wherein the tree is composed of a lightweight material.

3. A saddle according to claim 2, wherein the tree is composed of one of a lightweight polymer, a lightweight polymer reinforced with a carbon fibre and a carbon fibre.

4. A saddle according to claim 2, wherein the bridge is hingedly connected to the side panels using brackets secured to the side panels.

5. A saddle according to claim 4, wherein each bracket includes a first abutment which forms slideways in combination with a second abutment formed on each side of the bridge.

6. A saddle according to claim 5, further comprising a spacer structure situated in each slideway.

7. A saddle according to claim 6, further comprising:

a cross piece secured to at least one end of the spacer structure.

8. A saddlle according to claim 6, further comprising:

a cross piece secured to at least one end of the spacer structure.

9. A saddle according to claim 8, wherein the cross piece includes a fixing point.

10. A saddle according to claim 1, wherein the girth mounting includes three pivotable suspension elements, each having a pivot aperture.

11. A saddle according to claim 10, further comprising:

a girth plate situated on each side of the saddle, the girth plate being suspended by webbing from the suspension elements the girth plate being adapted for connection to a girth.

12. A saddle according to claim 1, wherein each stirrup mount is secured to a corresponding side panel, the stirrup mount being proud of a surface thereof to create a cantilever effect whereby each stirrup mount may flex relative to the corresponding side panel.

13. A saddle according to claim 1, wherein each girth panel is composed of layers of thermoformed low density polyethylene foam.

14. A saddle according to claim 13, wherein a first layer of the layers is denser than a second layer of the layers, the first layer being situated above the second layer.

15. A saddle according to claim 13, wherein the girth panels are covered with an outer surface material.

16. A saddle according to claim 15, wherein the outer surface material is composed of a waterproof material.

17. A saddle according to claim 15, further comprising:

a spacer fabric situated between the two layers and the outer surface material.

18. A saddle according to claim 17, wherein the spacer fabric is sealed on one side.

19. A saddle according to claim 1, wherein the tree includes a seat plate, the tree being secured to the side panels using the bridge.

20. A saddle according to claim 19, further comprising:

a seat pad overlying the seat plate.

21. A saddle according to claim 20, wherein the seat pad is composed of a low density polyethylene foam.

22. A saddle according to claim 21, wherein the seat pad is bonded to the seat plate.

* * * * *